US011969055B2

(12) United States Patent
Phillips et al.

(10) Patent No.: US 11,969,055 B2
(45) Date of Patent: Apr. 30, 2024

(54) FOOTWEAR ASSEMBLIES WITH BIFIT INSOLE BOARDS AND ASSOCIATED METHODS

(71) Applicant: LaCrosse Footwear, Inc., Portland, OR (US)

(72) Inventors: Gabriel Freedom Phillips, Portland, OR (US); Kyle Michael McMahon, Portland, OR (US); Danilo Carabeo Jiz de Ortega, Quezon (PH)

(73) Assignee: LaCrosse Footwear, Inc., Portland, OR (US)

( * ) Notice: Subject to any disclaimer, the term of this patent is extended or adjusted under 35 U.S.C. 154(b) by 369 days.

(21) Appl. No.: 17/465,453

(22) Filed: Sep. 2, 2021

(65) Prior Publication Data

US 2022/0061460 A1 Mar. 3, 2022

Related U.S. Application Data

(60) Provisional application No. 63/074,408, filed on Sep. 3, 2020.

(51) Int. Cl.

| | |
|---|---|
| ***A43B 13/41*** | (2006.01) |
| ***A43B 17/00*** | (2006.01) |
| ***A43B 23/08*** | (2006.01) |

(52) U.S. Cl.

CPC ..... *A43B 17/006* (2013.01); *A43B 13/41* (2013.01); *A43B 23/088* (2013.01)

(58) Field of Classification Search

CPC ..... A43B 17/006; A43B 13/41; A43B 13/42; A43B 13/12; A43B 13/125; A43B 13/127; A43B 23/088; A43B 9/02; A43B 13/386

See application file for complete search history.

(56) References Cited

U.S. PATENT DOCUMENTS

| | | | | |
|---|---|---|---|---|
| 4,852,275 | A * | 8/1989 | Bianchini | A43B 5/00 36/11 |
| 4,942,679 | A * | 7/1990 | Brandon | A43B 3/10 36/108 |
| 5,832,634 | A | 11/1998 | Wong | |
| 6,484,420 | B1 | 11/2002 | Chi et al. | |

(Continued)

OTHER PUBLICATIONS

International Searching Authority, International Search Report and Written Opinion, PCT Patent Application PCT/US2021/048873, dated Dec. 14, 2021, 12 pages.

*Primary Examiner* — Jameson D Collier
(74) *Attorney, Agent, or Firm* — Perkins Coie LLP

(57) ABSTRACT

A footwear assembly with an insole assembly having a heel insole board above a midsole and a bifit insole board, which has a heel portion that is stiffer than a forefoot portion. The bottom edge flanges of the upper wrap around the sides of the bifit insole board's heel portion and arch portion rearward of an attachment transition area. At least a portion of the flanges are adhered between the bifit insole board and the heel insole board. The upper's flanges are positioned adjacent to sides of the bifit insole board's forefoot portion and arch portion forward of the attachment transition area without wrapping under the bifit insole board. The upper's flanges are stitched to a top or edge of the bifit insole board's forefoot portion and arch portion forward of the attachment transition area.

20 Claims, 4 Drawing Sheets

(56) References Cited

U.S. PATENT DOCUMENTS

| | | | | |
|---|---|---|---|---|
| 2001/0032397 | A1* | 10/2001 | Ho | A43B 13/12 36/43 |
| 2003/0182822 | A1* | 10/2003 | Chen | A43B 7/28 36/92 |
| 2005/0022425 | A1 | 2/2005 | Brown | |
| 2015/0068066 | A1 | 3/2015 | Ludemann et al. | |
| 2016/0051012 | A1 | 2/2016 | Avar et al. | |
| 2018/0103727 | A1* | 4/2018 | Fracassi | A43B 23/026 |

* cited by examiner

FOOTWEAR ASSEMBLIES WITH BIFIT INSOLE BOARDS AND ASSOCIATED METHODS

CROSS REFERENCE TO RELATED APPLICATION

This patent application claims the benefit of and priority to U.S. Provisional Patent Application No. 63/074,408, titled FOOTWEAR ASSEMBLIES WITH BIFIT INSOLE BOARDS AND ASSOCIATED METHODS, filed Sep. 3, 2020, and which is incorporated herein in its entirety by reference thereto.

TECHNICAL FIELD

The present disclosure is generally directed to footwear assemblies having stiffness transitions along the footbed, and more particularly, to footwear assemblies having a sole assembly with a variable stiffness insole assembly.

BACKGROUND

Articles of footwear have been designed for a wide variety of physical activities including walking, running, hiking, trekking, hunting, backpacking, and indoor and outdoor activities. For example, hiking and work boots are typically designed to provide a wearer with suitable comfort and support for hiking or walking on uneven or rough terrain. Conventional hiking or work boots, however, can be relatively heavy. Every time a wearer takes a step, such as while walking or hiking, the wearer must lift the weight of the boot. After hundreds or thousands of steps, that additional weight can be fatiguing on the wearer's legs. Accordingly, it is highly desirable to minimize the weight of the footwear without overly compromising the stability and support of the footwear.

Footwear, such as a boot, is often designed in view of a typical wearer's gait cycle. The typical gate cycle includes several phases, including heel strike, flat foot, heel off, and toe off. During heel strike, the boot initially strikes the ground at approximately the rear, medial portion of the boot's heel area. As the gait cycle progresses from heel strike toward flat foot, the loads are applied along the medial side of the heel portion. Progressing from flat foot through heel off and toe off, the loads typically move forwardly to the forefoot area of the boot and diagonally from the medial side to the lateral side of the boot. Accordingly, during heel off and toe off, the primary loads are at the lateral side of the forefoot until the wearer pushes off with his/her toes. A properly designed boot or other footwear can facilitate the wearer's gait cycle while providing stability and support to the wearer's foot and leg.

U.S. Pat. Nos. 6,484,420; 6,757,990; 8,789,292; and 9,591,888 disclose a significant advancement in footwear technology to achieve a lightweight footwear assembly while maintaining a very stable platform. U.S. Pat. Nos. 6,484,420; 6,757,990; 8,789,292; and 9,591,888 are incorporated herein in their entirety by reference. The lightweight footwear assembly incorporates a construction wherein at least a portion of the lateral and medial peripheral flanges of the upper are stitched to the insole in the phalangeal and/or heel portions but they are not stitched to the insole through the arch portion. Additionally, the lateral and medial peripheral flange of the upper is wrapped around the lateral peripheral edge of the insole in the arch portion and the medial peripheral flange of the upper is wrapped around the medial peripheral edge of the insole in the arch portion. Moreover, the lateral and medial peripheral flanges are secured to the bottom surface of the arch portion of the insole. This construction provides a very lightweight and stable platform, although there are areas where improvements may be made for selected footwear.

DETAILED DESCRIPTION

Figure 1:
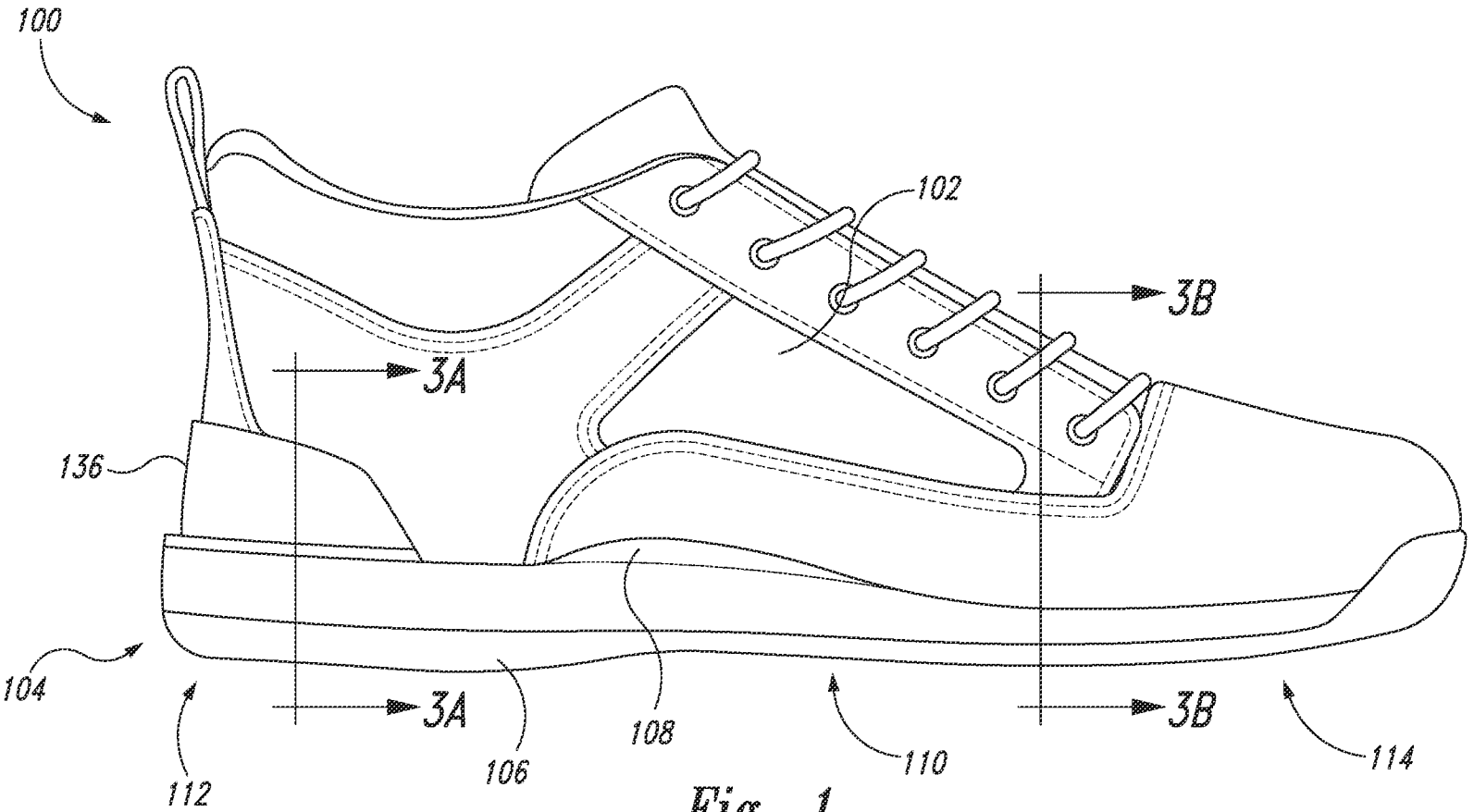
FIG. 1 is a side view of a footwear assembly in accordance with an embodiment of the present technology.

Footwear assemblies with uppers securely attached to reinforced insole boards via adhesive and stitching, and associated methods for using and making such assemblies, are described in detail herein in accordance with embodiments of the present disclosure. The footwear assemblies described herein include features that increase stability in the heel and arch areas, with a transition to compliance in the forefoot area. In this regard, some configurations allow stability and support during the heel strike and flat foot of the user's gait cycle, while increasing compliance, energy transfer, and/or comfort in the transition from flat foot to heel off and toe off.

In one embodiment, for example, a footwear assembly includes an upper coupled to a sole assembly with a U-shaped first insole board coupled to a full-length bifit insole board with a plurality of stiffnesses, and a transition member attached to the bifit insole board at a transition between areas of different stiffnesses, such as in the arch and heel areas of the footwear, respectively. Accordingly, the transition member spans the transition area of the bifit insole board and at least partially extends from the arch area forward toward the forefoot area and rearward toward the heel area. In the heel area, the first insole board extends around a peripheral portion of the heel area. The bifit insole board can be a full-length insole board with the transition member coupled to the bottom of the bifit insole board in the arch area and at least a portion of the first insole board in the heel area.

In some embodiments, the peripheral edge portion of the upper in the forefoot area is stitched to the top surface of the bifit insole board or stitched laterally to the bifit insole board. The stitching extends around the forefoot area and terminates on the medial and lateral sides at only to an intermediate position in the arch portion above the transition member. At the position where the stitching ends in the arch portion is a transition point, after which the peripheral edge portion of the upper is wrapped around to the bottom surface of the bifit insole board. In the areas rearward of the transition point where the peripheral edge portion of the upper is wrapped around the bottom surface of the bifit insole board (e.g., a portion of the arch area and the heel area), the upper is adhered either between the top surfaces of the transition member and the first insole board and the bottom surface of the bifit insole board, or to the bottom surfaces of one or more of the transition member, the first insole board, and the bifit insole board. The transition point is at an intermediate position in the arch area above the transition member, such that stitching along the upper does not extend completely through the arch area of the footwear to the heel area and the transition member spans the areas on either side of the transition point, as will be explained in greater detail below. In other embodiments, the upper may include an additional layer, such as a water-proof membrane, that is fully slip-lasted (e.g., a Strobel construction) above the bifit insole board and may be covered by a gasket.

The footwear assemblies overcome drawbacks experienced in the prior art and provide other benefits. Certain details are set forth in the following description and in FIGS. 1-4 to provide a thorough and enabling description of various embodiments of the disclosure. Other details describing well-known structures and components often associated with footwear assemblies and methods of forming such assemblies, however, are not set forth below to avoid unnecessarily obscuring the description of various embodiments of the disclosure. Many of the details, dimensions, angles, relative sizes of components, and/or other features shown in the Figures are merely illustrative of particular embodiments of the disclosure. Accordingly, other embodiments can have other details, dimensions, angles, sizes, and/or features without departing from the spirit and scope of the present disclosure. In addition, further embodiments of the disclosure may be practiced without several of the details described below, while still other embodiments of the disclosure may be practiced with additional details and/or features. In the Figures, identical reference numbers identify identical, or at least generally similar, elements. Moreover, one of ordinary skill in the art will appreciate that any relative positional terms such as above, below, over, under, etc. do not necessarily require a specific orientation of the footwear assemblies as described herein. Rather, these or similar terms are intended to describe the relative position of various features of the disclosure described herein.

FIG. 1 is a side view of a footwear assembly 100 ("assembly 100") configured in accordance with an embodiment of the present technology. The assembly 100 can be included in boots, shoes, or other articles of footwear and is not limited to the footwear shown in FIG. 1. In the illustrated embodiment, the assembly 100 includes an upper 102 attached to a sole assembly 104. The sole assembly 104 includes an outsole 106 coupled to a midsole 108, as well as an insole assembly attached to the upper 102 and the midsole 108 as described in detail below with reference to FIGS. 2-4. The sole assembly 104 has an arch portion 110 positioned between a heel portion 112 and a forefoot portion 114. The sole assembly 104, and in particular the arch portion 110 and heel portion 112, are configured to provide increased support and stability, as well as secure attachment to the upper 102.

Figure 2:
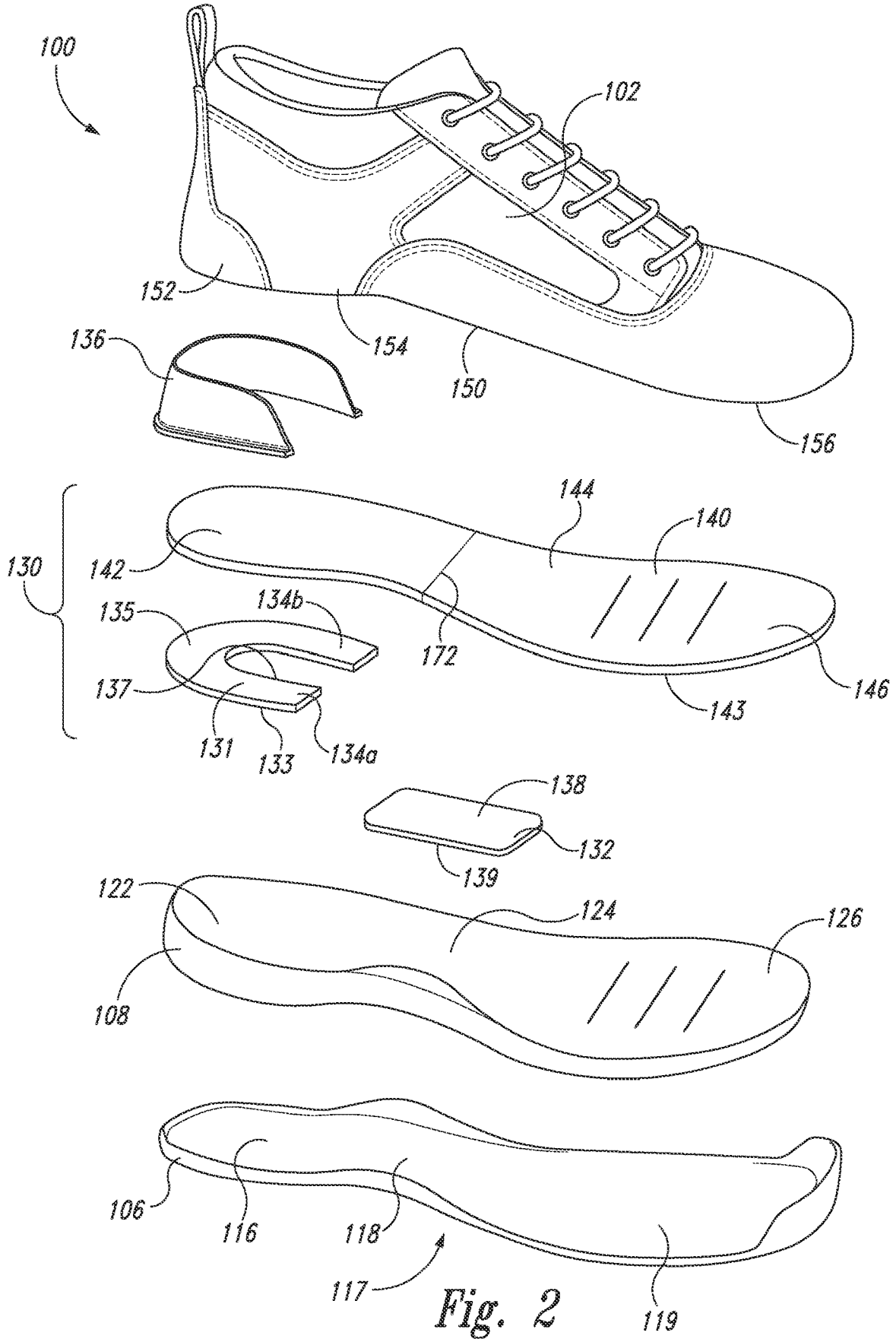
FIG. 2 is a perspective partially exploded view of the footwear assembly of FIG. 1.

FIG. 2 is an isometric partially exploded view of the footwear assembly 100 of FIG. 1, illustrating several features of the sole assembly 104. The outsole 106 has an exterior tread portion 117 and has an outsole arch portion 118 between an outsole heel portion 116 and an outsole forefoot portion 119. The outsole 106 can be made from rubber (e.g., natural or synthetic), leather, or other suitable footwear materials or combinations of materials. The top of the outsole 106 is attached to the midsole 108. In the illustrated embodiment, the midsole 108 is a full-length midsole with an arch portion 124 between a heel portion 122 and a forefoot portion 126. The heel portion 122 may include a cushioned heel section (not shown) that provides additional support or cushioning in the heel portion 122. The arch and/or heel portions 124 and 122 may also include one or more recesses or indentations configured to receive other components of the footwear assembly 100, such as portions of an insole assembly 130, as will be described in greater detail below. Although the midsole 108 is shown as one component, in other embodiments the midsole 108 can be formed from any number of pieces. Moreover, in still further embodiments, the midsole 108 can be integrally formed with the outsole 106 or omitted from the sole assembly 104. The midsole 108 can be formed from rubber, ethylene vinyl acetate (EVA), closed cell foam material, and/or other suitable footwear materials. As such, the midsole 108 can provide support and comfort for a user by dispersing the user's weight and providing stability and/or shock absorption.

The midsole 108 supports the insole assembly 130 and a transition member 132, each configured to be positioned directly below a user's foot when inserted into the assembly 100. In the illustrated embodiment, the insole assembly 130 is a multi-piece assembly that includes a first insole board 135 and a second bifit insole board 140, which may be referred to as a bifit insole board 140. The transition member 132 is configured to be generally positioned in the arch area of the assembly 100 and is shaped in an elongate plate configuration. More specifically, the transition member 132 can be a shank stiffener or support that includes a first or lower surface 139 opposite a second or upper surface 138. The lower surface 139 faces the midsole 108 and/or outsole 106, and the upper surface 138 faces the bifit insole board 140. When assembled, the position of the transition member 132 is generally forward of the first insole board 135 and extends forward toward the forefoot portion 126. In other embodiments, however, the transition member 132 can overlap the first insole board 135, e.g., into an inner opening 137. In still further embodiments, the transition member 132 has any suitable shape and/or includes interior opening(s). The transition member 132 is configured to span transitions in the bifit insole board 140 and in attachment portions between the upper 102 and the bifit insole board 140, as will be explained in greater detail below with reference to FIGS. 3A-4.

The first insole board 135 of the illustrated embodiment is configured to be positioned in the heel area of the assembly 100 and includes a generally U-shaped configuration. More specifically, the first insole board 135 can be a stiffener or support that includes a first or lower surface 133 opposite a second or upper surface 131. The lower surface 133 faces the midsole 108 and/or outsole 106, and the upper surface 131 faces the bifit insole board 140. The first insole board 135 further includes the first insole inner opening 137 at least partially defined between corresponding legs or end portions 134 of the U-shaped configuration (identified individually as a first leg **134*a* and a second leg 134*b*). In other embodiments, however, the inner opening 137 of the first insole board 135 can be smaller, semi-circle, oval, or fully enclosed. In still further embodiments, the first insole board 135** can be a structure without any interior opening.

The bifit insole board 140 of the illustrated embodiment is a full-length insole component configured to provide added support. The bifit insole board 140 includes a first or lower surface 143 opposite a second or upper surface 141. The bifit insole board 140 further includes an arch portion 144 positioned between a forefoot portion 146 and a heel portion 142. In some embodiments, the bifit insole board 140 has a dual construction wherein the heel portion 142 has a different stiffness (e.g., a higher stiffness material, a thicker cross-section, and/or stiffening/flexion features, such as ridges, thickened segments, longitudinal grooves corrugations/channels or other features), compared to the arch portion 144 and/or the forefoot portion 146. The stiffness of the bifit insole board 140 may change in one or more locations along a length of the bifit insole board 140, such as at a transition 172, which can be any suitable shape, e.g., a line, an arc, etc., or may be a transition area where the stiffness changes over a distance along the length. More specifically, the portion of the bifit insole board 140 rearward of the transition 172 may have a higher stiffness (e.g., by use of a different material, thickness, durometer, and/or stiffening/flexion features) than the remainder of the bifit insole board 140 forward of the transition 172, and the transition 172 may be positioned above at least a portion of the transition member 132, such that the transition member 132 is connected to portions of the bifit insole board 140, spans across the transition 172, and extends forwardly and rearwardly away from the transition 172. The transition 172 is forward of the first insole board 135. In other embodiments, the bifit insole board 140 may have multiple transitions or transition areas along the length and the transitions may have different stiffness change types, such as a material change at a first transition, a thickness change along a second transition area, a stiffening/flexion feature along a third transition area, etc. or any combination thereof.

In the illustrated embodiment, the bifit insole board 140 is made of two or more materials that interconnect at the transition 172. The interconnection, and thus the transition 172, can be a gradual blended interconnection between the materials or can be an abrupt or distinct transition between the materials with substantially no blending of the different materials. The transition member 132 and the first and bifit insole boards 135 and 140 of the insole assembly 130 can be made from paper board, non-woven board, plastic, thermoplastic polyurethane (TPU), and/or other materials suitable for an insole assembly in a footwear assembly. In some embodiments, the transition member 132 and the first insole board 135 may be thicker and/or stiffer than the bifit insole board 140 to provide additional support and stability in the areas where the boards are located, such as the heel and arch areas.

According to additional features of the illustrated embodiment, the upper 102 includes a peripheral edge portion 150 extending around a lower section of the upper 102. The upper 102 also includes an arch portion 154 between a heel portion 152 and a forefoot portion 156. As described in greater detail below, the peripheral edge portion 150 of the upper 102 is configured to be securely attached to the insole assembly 130. In the illustrated embodiment, an external heel cup 136 is provided in the heel area, joining the heel area of the upper 102 and an upper surface 131 of the first insole board 135. The heel cup 136 may be stitched to the first insole board 135. The heel cup 136 may be configured to provide stiffness and/or support in the heel area of the assembly 100. In the illustrated embodiment, the heel cup 136 is an external heel cup forming an exterior heel portion of the footwear, such that the external heel cup is visible. In other embodiments, the heel cup 136 can be an internal component not visible from the exterior of the footwear. The heal cup 136 may comprise one or more suitable materials, such as leather, thermoplastic polyurethane (TPU), polyurethane (PU), synthetic materials, etc.

Figure 3A:
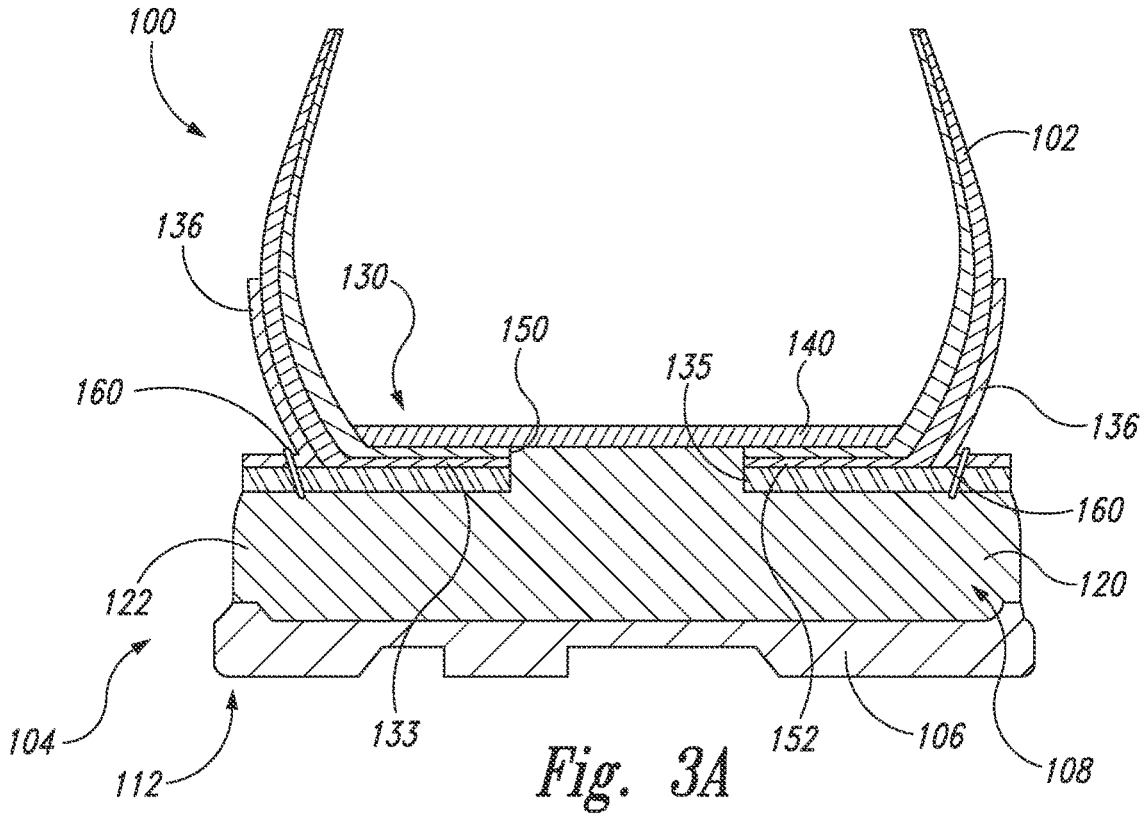
FIG. 3A is a cross-sectional end view taken substantially along lines 3A-3A of FIG. 1.

FIG. 3A is a cross-sectional end view of the assembly 100 taken substantially along lines 3A-3A of FIG. 1 and illustrating several features of the heel portion 112 of the sole assembly 104. According to features of the embodiment illustrated in FIG. 3A, the outsole 106 is secured (e.g., adhered) directly to the midsole 108, the midsole 108 is secured (e.g., adhered) directly to each of the first insole board 135 and the bifit insole board 140. In addition, the heel portion 152 of the upper's peripheral edge portion 150 is also secured (e.g., adhered) between the first insole board 135 and the bifit insole board 140 near the lateral and medial edges of the first insole board 135. As such, the heel portion 152 of the upper peripheral edge portion 150 is positioned immediately adjacent to the lower surface 143 of the bifit insole board 140 and adjacent the upper surface 131 of the first insole board 135. In some embodiments, the heel cup 136 is cemented to the heel portion 152 of the upper 102 and to the top surface 131 of the first insole board 135. The heel cup 136 is stitched to the first insole board 135 with the heel portion stitching 160. In other embodiments, the heel cup 136 is only cemented or stitched to the upper 102 or other component of the assembly 100. In the illustrated configuration, the heel portion stitching 160 is externally visible at the heel portion 112 of the assembly 100.

According to additional features of the illustrated embodiment, the upper peripheral edge portion 150 is not stitched or sewn directly to the bifit insole board 140 in the heel portion 112 of the sole assembly 104, nor is the upper peripheral edge portion 150 stitched or sewn directly to the midsole 108 in the heel portion 112 of the sole assembly 104. Instead, the first insole board 140 can be glued or otherwise adhered to the first insole board 135, and/or the peripheral edge portion 150 of the upper 102. Moreover, and as explained below with reference to FIG. 4, the upper peripheral edge portion 150 is stitched only from the forefoot portion 146 rearward to a transition point 170 along the arch portion 144 of the bifit insole board 140. Rearward of the transition point 170, the upper peripheral edge portion 150 can at least partially wrap inwardly around the arch portion 144, and be glued or otherwise adhered to the arch portion of the insole assembly 130 and/or the midsole 108. In this manner, the attachment of the upper 102 to the insole assembly 130 and the midsole 108 can help to form the heel cup configuration while maintaining the structural stability of the components of the overall platform.

Figure 3B:
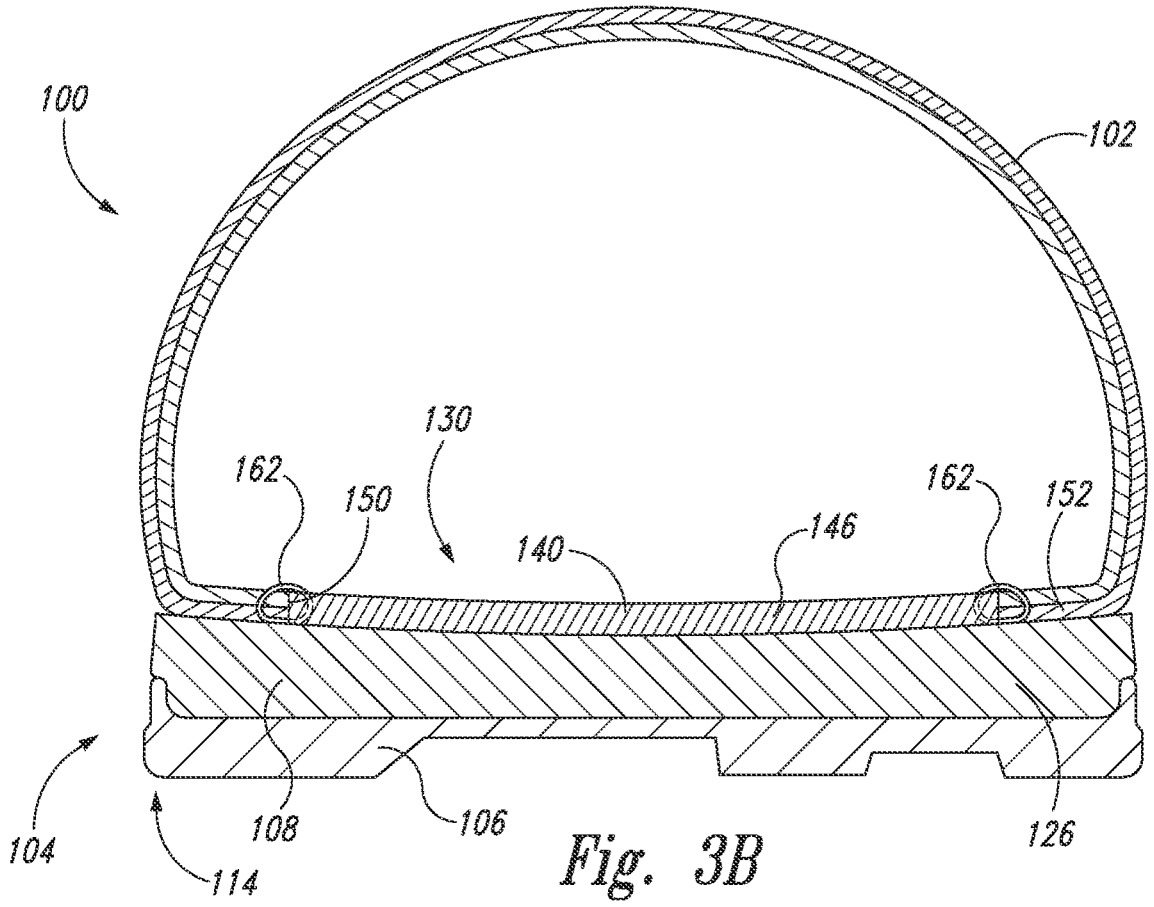
FIG. 3B is a cross-sectional end view taken substantially along lines 3B-3B of FIG. 1.

FIG. 3B is a cross-sectional end view of the assembly 100 taken substantially along lines 3B-3B of FIG. 1 and illustrating several features of the forefoot portion 114 of the sole assembly 104. For example, the outsole 106 is secured (e.g., adhered) directly to the midsole 108, the midsole 108 is secured (e.g., adhered) to the insole assembly 130, and the insole assembly 130 is secured (e.g., adhered and/or stitched) to the upper 102. More specifically, the forefoot portion 156 of the upper peripheral edge portion 150 flares inwardly and is stitched by a forefoot and arch portion stitching 162 to either the top surface 141 of the bifit insole board 140, or lateral to the bifit insole board 140 in an edge-to-edge abutting configuration. For instance, as shown in FIG. 3B, the upper peripheral edge portion 150 flares inwardly and is positioned over corresponding peripheries of the forefoot portion 126 of the midsole 108. The forefoot and arch portion stitching 162, however, is not applied to the arch portion 144 of the bifit insole board 140 rearward of the transition point 170 (see FIG. 4), and the peripheral edge portion 150 transitions underneath the bifit insole board 140 rearward of the transition point 170 and around the heel portion 142. In these embodiments, the forefoot and arch portion stitching 162 can be continuous, e.g., a spiraled configuration, individual stitches, or any combination of continuous and individual stitches. In other embodiments, the upper 102 may include a layer, such as a water-proof membrane (not shown), that is fully slip-lasted (e.g., a Strobel construction) above the bifit insole board 140 and may be covered by a gasket (not shown).

Figure 4:
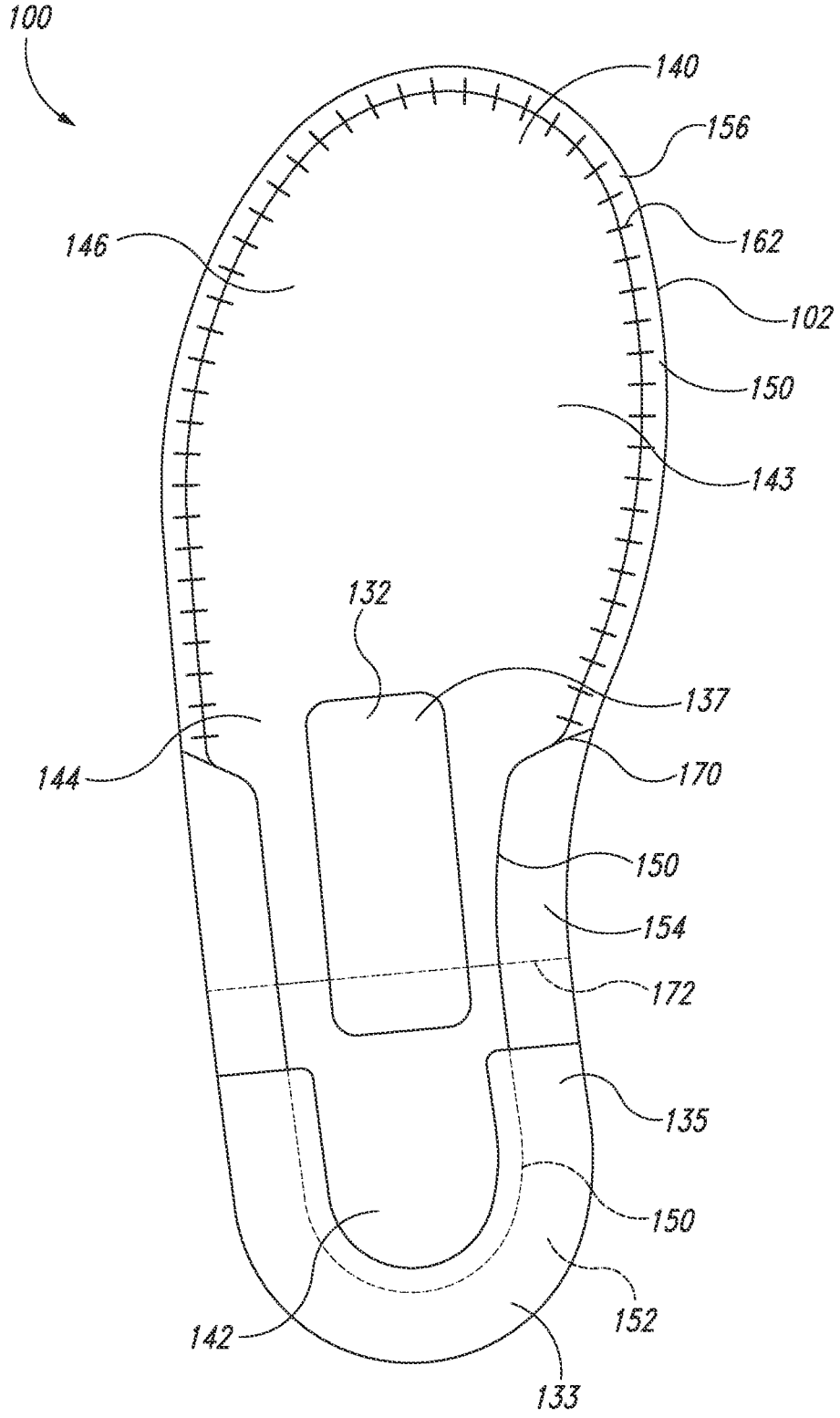
FIG. 4 is a bottom view of the footwear assembly of FIG. 1.

FIG. 4 is a bottom view of a portion of the footwear assembly 100, including the upper 102 coupled to the U-shaped first insole board 135, the full-length bifit insole board 140 that extends between the heel and toe areas, and the transition member 132. The upper 102, the transition member 132, and/or the first and bifit insole boards 135 and 140 are configured to be coupled to the midsole 108 and/or outsole 106. In the embodiment illustrated in FIG. 4, however, the corresponding midsole and/or outsole have been removed from the assembly 100 to illustrate several features of lower surfaces 139, 133, and 143 of the transition member, and the first and bifit insole boards 132, 135, and 140, respectively. The transition member 132 of the illustrated embodiment is an elongate plate structure and can be a stiffening shank. The transition member 132 is secured to the midsole 108 in the arch portion of the footwear, the first insole board 135 is a U-shaped structure secured to the bifit insole board 140 in the heel portion of the footwear, and the bifit insole board 140 is a substantially full length component having an arch insole portion 144 positioned between the insole forefoot portion 146 and the insole heel portion 142. Although not shown in FIG. 4, in other embodiments the insole assembly 130 can include one or more openings to accommodate additional features of a sole assembly, such as cushioning features or other desired features.

As shown in FIG. 4, the upper 102 includes the peripheral edge portion 150, with the heel portion 152, the arch portion 154, and the forefoot portion 156. The heel portion 152 extends over and at least partially wraps inwardly around at least a portion of the lower surface 143 of the insole heel portions 142 of at least the bifit insole board 140, and above the upper surface 131 of at least the first insole board 135. The attachment of the upper 102 at the peripheral edge portion 150 changes at the transition point 170, which is generally located intermediate to the arch portion of the assembly 100. Ahead of the transition point 170, the forefoot portion 156 and part of the arch portion 154 of the peripheral edge portion 150 flares inwardly and is stitched or otherwise coupled laterally to the bifit insole board 140 in an edge-to-edge abutting configuration, or stitched or otherwise coupled to the top surface 141 of the bifit insole board 140. Rearward of the transition point 170, the heel portion 152 and part of the arch portion 154 of the peripheral edge portion 150 flare inwardly and are secured (e.g., adhered) between the first insole board 135 and the bifit insole board 140. As such, the heel portion 152 and part of the arch portion 154 of the upper peripheral edge portion 150 are positioned immediately adjacent to the lower surface 143 of the bifit insole board 140 and adjacent the upper surface 131 of the first insole board 135. In other embodiments, the upper 102 may include a layer, such as a water-proof membrane, that is fully slip-lasted (e.g., a Strobel construction) above the bifit insole board 140 and may be covered by a gasket.

The transition member 132 spans both of the transitions (the transition point 170 and the transition 172) of the footwear assembly 100. In this regard, the transition member 132 extends across the transition point 170, at which the attachment of the upper to the insole assembly 130 changes from stitching to a wrap under the bifit insole board 140. The transition member 132 also extends across the transition 172 of the bifit insole board 140, at which the stiffness of the bifit insole board 140 changes, having a higher stiffness rearward of the transition 172 than the stiffness forward of the transition 172. The transitions in the footwear assembly are configured to provide comfort to the wearer while maintaining stability during the gait cycle.

For example, the transition from a stitched coupling of the upper 102 and the bifit insole board 140, together with the lower stiffness material ahead of the transition 170, is configured to provide comfort and compliance in the forefoot area during the heel off and toe off gait cycle phases. Conversely, the stiffer material of the bifit insole board 140 rearward of the transition 172, together with the first insole board 150 and the construction of the upper between the first and bifit insole boards 135 and 140 provides increased stability in the heel area during the heel strike and flat foot gait cycle phases. In some embodiments, the transition point 170 is offset along the length of the footwear assembly 100 from the transition 172 such that the transition in stiffness is gradual as opposed to abrupt, as to avoid a discomfort to the wearer. As noted above, the transition member 132 is configured to span the transition point 170 and the transition 172, which further minimizes abrupt changes in the stiffness of the footwear assembly 100 that may be perceivable by the wearer. In this regard, the transition member 132 provides continuity in stiffness as the footwear assembly 100 flexes through the wearer's gait cycle phases, allowing transition from the stiff heel area to the compliant forefoot area without perception by the wearer.

In some embodiments, aspects of the present technology provides a footwear assembly with an upper having edge portions forming medial and lateral side flanges, and a sole assembly coupled to the upper and having an outsole, a midsole above the outsole, and an insole assembly above the midsole. The midsole can have a first top surface facing away from the outsole, has second lateral and medial sides, and has a first heel portion, a first forefoot portion, and a first arch portion between the first heel and forefoot portions. The insole assembly is coupled to the first top surface of the midsole. The insole assembly has a first insole board positioned above at least the first heel portion of the midsole and has a bifit insole board supported atop the midsole. The first insole board is between the midsole and the bifit insole board. The bifit insole board has a second heel portion, a second arch portion and a second forefoot portion positioned above the first heel, arch, and forefoot portions of the midsole, respectively. The second heel portion of the bifit board has a first stiffness, and the second forefoot portion has a second stiffness less than the first stiffness. The bifit insole board has a stiffness transition portion between the second heel and forefoot portions that transitions between the first and second stiffnesses. The medial and lateral side flanges of the upper wrap around first medial and lateral sides of the second heel portion, respectively, and around the sides of a rear portion of the second arch portion of the bifit insole board rearward of an attachment transition area. The medial and lateral side flanges are secured under the second heel portion and the second arch portion rearward of the attachment transition area, with at least a portion of the medial and lateral side flanges securely retained between a bottom of the bifit insole board and a top of the first insole board. The medial and lateral side flanges of the upper are positioned adjacent to second medial and lateral sides of the second forefoot portion of the bifit insole board and a forward portion of the second arch portion without wrapping under the bifit insole board. The medial and lateral side flanges of the upper are stitched to a top or edge of the second forefoot portion and the forward portion of the second arch portion forward of the attachment transition area. The medial and lateral side flanges of the upper are not stitched to bifit insole board rearward of the attachment transition area, such that the medial and lateral side flanges transition from a position under the bifit insole board rearward of the attachment transition area and to adjacent or above the fit insole board forward of the attachment transition area.

A stiffening transition member can be positioned between the first arch portion of the midsole and the second arch portion of the bifit insole board. The stiffening transition member can extend under the stiffness transition area and/or the attachment transition area. A heel cup can be attached to the upper and have at least a portion of the medial and lateral side flanges stitched to peripheral portions of the first insole board. At least part of the second heel portion of the bifit insole board can be made of a first material with the first stiffness, and at least part of the second forefoot portion of the bifit insole board can be made of a second material different than the first material and with the second stiffness, and the bifit insole board transitions between the first and second materials in the stiffness transition portion. Portions of the medial and lateral side flanges of the upper can be adhered with an adhesive to the bottom of the bifit insole board and the top of the first insole board. Portions of the medial and lateral side flanges of the upper abuttingly engage and are stitched to the edge of the second forefoot portion of the bifit insole board.

Another embodiment of the present technology provides a footwear assembly, comprising an upper having medial and lateral side flanges, an insole assembly connected to the upper, and a midsole below the insole assembly and having first heel, forefoot and arch portions. The insole assembly has a first insole board positioned above at least the first heel portion of the midsole. The insole assembly has a bifit insole board between the midsole and the bifit insole board. The bifit insole board has a second heel, arch and forefoot portions above the first heel, arch, and forefoot portions of the midsole, respectively. The second heel portion of the bifit board has a first stiffness, and the second forefoot portion has a second stiffness less than the first stiffness, and has a stiffness transition portion between the second heel and forefoot portions that transitions between the first and second stiffnesses. The medial and lateral side flanges of the upper are wrapped around first medial and lateral sides of the second heel portion, respectively, and are wrapped around second medial and lateral sides of the second arch portion along at least a rear portion of the second arch portion of the bifit insole board rearward of an attachment transition area. The medial and lateral side flanges are secured under the second heel portion and the second arch portion rearward of the attachment transition area, with the medial and lateral side flanges being securely retained between a bottom of the bifit insole board at the second heel portion and a top of the first insole board. The medial and lateral side flanges of the upper are positioned adjacent to third medial and lateral sides of the second forefoot portion of the bifit insole board and adjacent to a forward portion of the second arch portion without wrapping under the bifit insole board. The medial and lateral side flanges of the upper are stitched to a top or edge of the second forefoot portion and the forward portion of the second arch portion forward of the attachment transition area. The medial and lateral side flanges of the upper are not stitched to the bifit insole board rearward of the attachment transition area, and the medial and lateral side flanges transition from a position under the bifit insole board rearward of the attachment transition area and to adjacent or above the fit insole board forward of the attachment transition area.

Another embodiment provides a footwear assembly comprising an upper having medial and lateral side flanges, a sole assembly attached to the upper and having an outsole, a midsole atop the outsole, an insole assembly atop the midsole, and a shank. The midsole has second lateral and medial sides and has a first heel portion, a first forefoot portion, and a first arch portion between the first heel and forefoot portions. The insole assembly has a U-shaped first insole board positioned above at least the first heel portion of the midsole, wherein the first insole board has an interior opening exposing the midsole and positioned to be under the heel of a wearer's foot. The insole assembly has a bifit insole board supported atop the midsole. The first insole board is sandwiched between the first heel portion of the midsole and the bifit insole board. The bifit insole board has a second heel portion, a second arch portion and a second forefoot portion positioned above the first heel, arch, and forefoot portions of the midsole, respectively. The second heel portion of the bifit board is made of a first material having a first stiffness, and the second forefoot portion is made of a second material different than the first material and having a second stiffness less than the first stiffness, and having a stiffness transition portion between the second heel and forefoot portions that transitions between the first and second materials and between the first and second stiffnesses. The shank is positioned between the first arch portion of the midsole and the second arch portion of the bifit insole board. The medial and lateral side flanges of the upper wrap around first medial and lateral sides of the second heel portion, respectively, and a rear portion of the second arch portion of the bifit insole board rearward of an attachment transition area. The medial and lateral side flanges are adhered to a bottom surface of the bifit insole board under the second heel portion and the second arch portion rearward of the attachment transition area, with the medial and lateral side flanges of the upper being securely retained between a top of the first insole board and a bottom of the second heel portion of the bifit insole board. The medial and lateral side flanges of the upper are positioned adjacent to second medial and lateral sides of the second forefoot portion of the bifit insole board and a forward portion of the second arch portion without wrapping under the bifit insole board. The medial and lateral side flanges of the upper are stitched to a top or edge of the second forefoot portion and the forward portion of the second arch portion forward of the attachment transition area, and the medial and lateral side flanges of the upper are not stitched to bifit insole board rearward of the attachment transition area. The medial and lateral side flanges transition from a position under the bifit insole board rearward of the attachment transition area and to adjacent or above the fit insole board forward of the attachment transition area. The shank extends under the stiffness transition area and the attachment transition area.

As used in the foregoing description, the terms "vertical," "lateral," "medial," "upper," and "lower" can refer to relative directions or positions of features in the footwear assembly in view of the orientation shown in the Figures. For example, "upper" or "uppermost" can refer to a feature positioned closer to the top of a page than another feature. These terms, however, should be construed broadly to include waveguides having other orientations, such as inverted or inclined orientations where top/bottom, over/under, above/below, up/down, left/right, and distal/proximate can be interchanged depending on the orientation. Moreover, for ease of reference, identical reference numbers are used to identify similar or analogous components or features throughout this disclosure, but the use of the same reference number does not imply that the features should be construed to be identical. Indeed, in many examples described herein, identically numbered features have a plurality of embodiments that are distinct in structure and/or function from each other. Furthermore, the same shading may be used to indicate materials in cross section that can be compositionally similar, but the use of the same shading does not imply that the materials should be construed to be identical unless specifically noted herein.

The foregoing disclosure may also reference quantities and numbers. Unless specifically stated, such quantities and numbers are not to be considered restrictive, but exemplary of the possible quantities or numbers associated with the new technology. Also, in this regard, the present disclosure may use the term "plurality" to reference a quantity or number. In this regard, the term "plurality" is meant to be any number that is more than one, for example, two, three, four, five, etc. For the purposes of the present disclosure, the phrase "at least one of A, B, and C," for example, means (A), (B), (C), (A and B), (A and C), (B and C), or (A, B, and C), including all further possible permutations when greater than three elements are listed.

From the foregoing, it will be appreciated that specific embodiments of the new technology have been described herein for purposes of illustration, but that various modifications may be made without deviating from the present disclosure. For example, although many of the Figures described above illustrate the midsoles and insoles as having multiple separate components, in other footwear assemblies the midsoles and insoles can include more or less components, including, for instance, integral or one-piece configurations. Furthermore, certain aspects of the new technology described in the context of particular embodiments may also be combined or eliminated in other embodiments. Moreover, although advantages associated with certain embodiments of the new technology have been described in the context of those embodiments, other embodiments may also exhibit such advantages and not all embodiments need necessarily exhibit such advantages to fall within the scope of the present disclosure. Accordingly, the present disclosure and associated technology can encompass other embodiments not expressly shown or described herein.

We claim:

1. A footwear assembly, comprising:

an upper having edge portions forming medial and lateral side flanges;

a sole assembly coupled to the upper and having an outsole, a midsole above the outsole, and an insole assembly above the midsole, the midsole having a first top surface facing away from the outsole, having first lateral and medial sides, and having a first heel portion, a first forefoot portion, and a first arch portion between the first heel and forefoot portions, the insole assembly being coupled to the first top surface of the midsole, the insole assembly having a first insole board positioned above at least the first heel portion of the midsole, and having a bifit insole board supported atop the midsole, the first insole board being between the midsole and the bifit insole board, the bifit insole board having a second heel portion, a second arch portion and a second forefoot portion positioned above the first heel, arch, and forefoot portions of the midsole, respectively, the second heel portion of the bifit insole board having a first stiffness, and the second forefoot portion having a second stiffness that is less than the first stiffness, and having a stiffness transition portion between the second heel and forefoot portions that transitions between the first and second stiffnesses;

wherein the medial and lateral side flanges of the upper wrap around second medial and lateral sides of the second heel portion, respectively, and a rear portion of the second arch portion of the bifit insole board rearward of an attachment transition area, and the medial and lateral side flanges are secured under the second heel portion and the second arch portion rearward of the attachment transition area, with at least a portion of the medial and lateral side flanges securely retained between a bottom of the bifit insole board and a top of the first insole board; and wherein the medial and lateral side flanges of the upper are positioned adjacent to third medial and lateral sides of the second forefoot portion of the bifit insole board and a forward portion of the second arch portion without wrapping under the bifit insole board, the medial and lateral side flanges of the upper being stitched to a top or an edge of the second forefoot portion and the forward portion of the second arch portion forward of the attachment transition area, and the medial and lateral side flanges of the upper are not stitched to the bifit insole board rearward of the attachment transition area, and the medial and lateral side flanges transition from a position under the bifit insole board rearward of the attachment transition area and to adjacent or above the bifit insole board forward of the attachment transition area.

2. The footwear assembly of claim 1, further comprising a stiffening transition member positioned between the first arch portion of the midsole and the second arch portion of the bifit insole board.

3. The footwear assembly of claim 2 wherein the stiffening transition member extends under the stiffness transition portion and the attachment transition area.

4. The footwear assembly of claim 2 wherein the stiffening transition member is a shank extending under the stiffness transition portion.

5. The footwear assembly of claim 1, further comprising a heel cup attached to the upper and having the at least a portion of the medial and lateral side flanges stitched to peripheral portions of the first insole board.

6. The footwear assembly of claim 1 wherein the stiffness transition portion is a shank captured between the midsole and the second arch portion of the bifit insole board.

7. The footwear assembly of claim 1 wherein at least a portion of the stiffness transition portion is in the second heel portion of the bifit insole board.

8. The footwear assembly of claim 1 wherein the bifit insole board has integral stiffening members in the stiffness transition portion.

9. The footwear assembly of claim 1 wherein at least part of the second heel portion of the bifit insole board is made of a first material with the first stiffness, and at least part of the second forefoot portion of the bifit insole board is made of a second material different than the first material and with the second stiffness, and the bifit insole board transitions between the first and second materials in the stiffness transition portion.

10. The footwear assembly of claim 1 wherein portions of the medial and lateral side flanges of the upper are adhered with an adhesive to the bottom of the bifit insole board and the top of the first insole board.

11. The footwear assembly of claim 10 wherein the portions of the medial and lateral side flanges of the upper abuttingly engage and are stitched to the edge of the second forefoot portion of the bifit insole board.

12. The footwear assembly of claim 1 wherein the first insole board is U-shaped with an interior opening between lateral and medial leg portions, wherein the interior opening is adapted to be positioned to be under a heel of a wearer's foot.

13. The footwear assembly of claim 1 wherein the first insole board terminates at a forward end that is rearward of the stiffness transition portion.

14. A footwear assembly, comprising:

an upper having medial and lateral side flanges;

an insole assembly connected to the upper; and a midsole below the insole assembly and having first heel, forefoot and arch portions;

the insole assembly having a first insole board positioned above at least the first heel portion of the midsole, the insole assembly having a bifit insole board between the midsole and the bifit insole board, the bifit insole board having second heel, arch, and forefoot portions above the first heel, arch, and forefoot portions of the midsole, respectively, the second heel portion of the bifit insole board having a first stiffness, and the second forefoot portion having a second stiffness less than the first stiffness, and having a stiffness transition portion between the second heel and forefoot portions that transitions between the first and second stiffnesses;

the medial and lateral side flanges of the upper being wrapped around the second medial and lateral sides of the second heel portion, respectively, and being wrapped around fourth medial and lateral sides of the second arch portion along at least a rear portion of the second arch portion of the bifit insole board rearward of an attachment transition area, and the medial and lateral side flanges being secured under the second heel portion and the second arch portion rearward of the attachment transition area, with the medial and lateral side flanges being securely retained between a bottom of the bifit insole board at the second heel portion and a top of the first insole board; and the medial and lateral side flanges of the upper being positioned adjacent to third medial and lateral sides of the second forefoot portion of the bifit insole board and adjacent to a forward portion of the second arch portion without wrapping under the bifit insole board, the medial and lateral side flanges of the upper being stitched to a top or an edge of the second forefoot portion and the forward portion of the second arch portion forward of the attachment transition area, wherein the medial and lateral side flanges of the upper are not stitched to the bifit insole board rearward of the attachment transition area, and the medial and lateral side flanges transition from a position under the bifit insole board rearward of the attachment transition area and to adjacent or above the bifit insole board forward of the attachment transition area.

15. The footwear assembly of claim 14, further comprising a stiffening transition member positioned between the first arch portion of the midsole and the second arch portion of the bifit insole board, wherein the stiffening transition member extends under the stiffness transition portion and the attachment transition area.

16. The footwear assembly of claim 14 wherein at least part of the second heel portion of the bifit insole board is made of a first material with the first stiffness, and at least part of the second forefoot portion of the bifit insole board is made of a second material different than the first material and with the second stiffness, and the bifit insole board transitions between the first and second materials in the stiffness transition portion.

17. The footwear assembly of claim 14 wherein the medial and lateral side flanges of the upper abuttingly engage and are stitched to the edge of the second forefoot portion of the bifit insole board.

18. The footwear assembly of claim 14 wherein the first insole board has an interior opening exposing the midsole, wherein the interior opening is adapted to be positioned to be under a heel of a wearer's foot.

19. A footwear assembly, comprising:

an upper having medial and lateral side flanges;

a sole assembly attached to the upper and having an outsole, a midsole atop the outsole, an insole assembly atop the midsole, and a shank, the midsole having first lateral and medial sides and having a first heel portion, a first forefoot portion, and a first arch portion between the first heel and forefoot portions, the insole assembly having a U-shaped first insole board positioned above at least the first heel portion of the midsole, wherein the first insole board has an interior opening exposing the midsole and adapted to be positioned to be under a heel of a wearer's foot, the insole assembly and having a bifit insole board supported atop the midsole, the first insole board being sandwiched between the first heel portion of the midsole and the bifit insole board, the bifit insole board having a second heel portion, a second arch portion and a second forefoot portion positioned above the first heel, arch, and forefoot portions of the midsole, respectively, the second heel portion of the bifit insole board being made of a first material having a first stiffness, and the second forefoot portion being made of a second material different than the first material and having a second stiffness less than the first stiffness, and having a stiffness transition portion between the second heel and forefoot portions that transitions between the first and second materials and between the first and second stiffnesses; and the shank is positioned between the first arch portion of the midsole and the second arch portion of the bifit insole board;

wherein the medial and lateral side flanges of the upper wrap around second medial and lateral sides of the second heel portion, respectively, and a rear portion of the second arch portion of the bifit insole board rearward of an attachment transition area, and the medial and lateral side flanges are adhered to a bottom surface of the bifit insole board under the second heel portion and the second arch portion rearward of the attachment transition area, with the medial and lateral side flanges of the upper being securely retained between a top of the first insole board and a bottom of the second heel portion of the bifit insole board;

wherein the medial and lateral side flanges of the upper are positioned adjacent to third medial and lateral sides of the second forefoot portion of the bifit insole board and a forward portion of the second arch portion without wrapping under the bifit insole board, the medial and lateral side flanges of the upper being stitched to a top or an edge of the second forefoot portion and the forward portion of the second arch portion forward of the attachment transition area, and the medial and lateral side flanges of the upper are not stitched to the bifit insole board rearward of the attachment transition area, and the medial and lateral side flanges transition from a position under the bifit insole board rearward of the attachment transition area and to adjacent or above the fit insole board forward of the attachment transition area; and wherein the shank extends under the stiffness transition portion and the attachment transition area.

20. The footwear assembly of claim 19 wherein the bifit insole board has integral stiffening members in the stiffness transition portion.

* * * * *